US006971348B1

(12) United States Patent
Sun

(10) Patent No.: US 6,971,348 B1
(45) Date of Patent: Dec. 6, 2005

(54) ENGINE VALVE ACTUATION CONTROL AND METHOD FOR STEADY STATE AND TRANSIENT OPERATION

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/987,057

(22) Filed: Nov. 12, 2004

Related U.S. Application Data

(60) Provisional application No. 60/589,692, filed on Jul. 21, 2004.

(51) Int. Cl.[7] ..... F01L 1/34

(52) U.S. Cl. ..... 123/90.15; 123/90.16; 123/90.11; 123/90.12

(58) Field of Search ..... 123/90.16, 90.15, 123/90.11, 90.12

(56) References Cited

U.S. PATENT DOCUMENTS

| | | | | |
|---|---|---|---|---|
| 5,456,222 | A | 10/1995 | Schechter | 123/90.12 |
| 5,638,781 | A | 6/1997 | Sturman | 123/90.12 |
| 6,109,284 | A | 8/2000 | Johnson et al. | 137/1 |
| 6,263,842 | B1 | 7/2001 | De Ojeda et al. | 123/90.12 |
| 2003/0101951 | A1 * | 6/2003 | Pierki | 123/90.16 |

OTHER PUBLICATIONS

SAE Technical Paper 2002-01-1109.
SAE Technical Paper 1999-01-0825.
SAE Technical Paper 2004-01-1265.

* cited by examiner

*Primary Examiner*—Thomas Denion
*Assistant Examiner*—Zelalem Eshete
(74) *Attorney, Agent, or Firm*—Kathryn A. Marra

(57) ABSTRACT

A valve actuator control monitors engine speed, engine valve timing, engine valve lift dwell duration and engine valve seating velocity and varies the timing of the engine valve event by adjusting the lift dwell duration of the engine valve while keeping time invariant opening and closing profiles.

14 Claims, 5 Drawing Sheets

ENGINE VALVE ACTUATION CONTROL AND METHOD FOR STEADY STATE AND TRANSIENT OPERATION

CROSS-REFERENCE TO RELATED APPLICATIONS

This application claims priority from U.S. Provisional Patent Application No. 60/589,692 filed Jul. 21, 2004.

TECHNICAL FIELD

This invention relates to engine valve trains and, more particularly, to a control and method for operating an engine valve actuator for an internal combustion engine.

BACKGROUND OF THE INVENTION

Valve actuators for camless valve trains of internal combustion engines have been proposed in the art. Such valve trains are often controlled with algorithms which provide limited bandwidth. However, the traditional engine valve motion profile is cyclic but aperiodic in time domain as engine speed changes. Some advanced control algorithms, such as repetitive control cannot be applied under speed transient conditions. To track these profiles precisely, the engine valve actuator must have the capability of precise tracking over a continuous frequency spectrum, which usually demands a powerful and expensive actuator. As a result, conventional controls cannot achieve satisfactory performance under speed transient conditions. So there is a need for a new control algorithm that does not demand an expensive actuator and is able to operate under both steady state and transient conditions.

It is desirable to provide an engine valve actuator control that adapts to changes in engine operating conditions to provide precise valve lift and satisfactory seating velocity over a wide range of conditions. It is also desirable to provide a valve actuator control having increased flexibility and full capacity for variable lift. Therefore, there is a need in the art to provide a valve actuator control and method, or algorithm, for an engine that meets these desires.

SUMMARY OF THE INVENTION

These desires are met by a control algorithm with simplified functions which involve time invariant (constant) trajectories of valve opening and valve closing with intermediate variable functions of dwell at the valve seat and at maximum valve lift to vary overall the opening timing and total duration of the engine valve event. Thus, the valve profile of the invention includes four parts: a seat dwell portion, an opening portion, a lift dwell portion and a closing portion. The valve opening and closing portions are time invariant, that is the opening portion and the closing portion respectively follow a fixed opening path and a fixed closing path. Each of these portions occupies a fixed (invariant) time period irrespective of engine speed and opens the valve to a fixed valve lift dimension. The seat (valve closed) and lift (valve opened) dwell portions are varied in time to provide opening and closing timings of valve operation which meet the operating requirements of the engine cycle at both constant and changing (transient) engine speeds.

The control operates with an algorithm that utilizes crank position and valve position sensors or calculations to determine when to initiate opening and closing of the valve and how long to hold the valve open during the lift dwell portion.

Control operation is simplified by an underlying principle that corrects the control problem from tracking over a continuous frequency spectrum to track at discrete frequency points, which can be accomplished with a less expensive and simpler actuator.

In an exemplary embodiment, the valve actuator control includes a repetitive control (RC) function and proportional integral derivative control (PIDC) function. The RC function of the control interfaces with a spool valve actuator driving a spool valve that is operative to initiate opening and closing of an engine valve on time invariant opening and closing trajectory from cycle to cycle.

The PIDC function of the control interfaces with the spool valve actuator to adjust the position of the spool valve when the valve is at seat or maximum lift and thereby alter engine valve opening timing and the duration of the engine valve event.

A sensor tracks the position of the engine valve during each cycle and relays the information to the control.

Each cycle, the RC function and the PIDC function of the control monitor engine speed, engine valve positioning and timing and determine the optimal engine valve opening timing, lift dwell, closing timing and seating velocity.

These and other features and advantages of the invention will be more fully understood from the following description of certain specific embodiments of the invention taken together with the accompanying drawings.

DESCRIPTION OF THE PREFERRED EMBODIMENT

Figure 1:
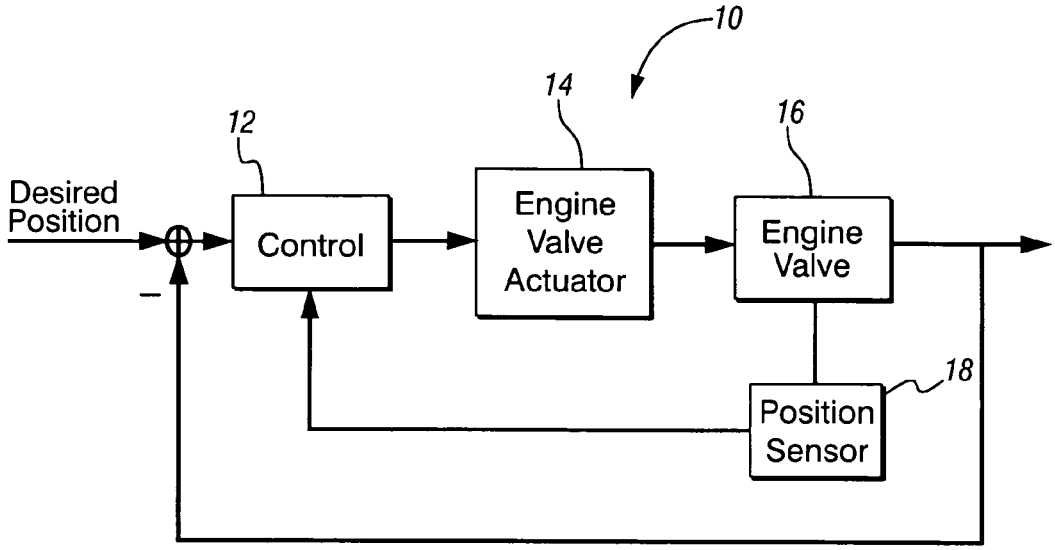
FIG. 1 is a block diagram illustrating a general arrangement of a valve actuator control according to the present invention.

Referring first to FIG. 1 of the drawings in detail, numeral 10 generally indicates a basic outline of a control system of the present invention. The control system 10 includes a control 12 incorporating an algorithm which may be implemented by any suitable control methods, such as a repetitive control (RC) function and a proportional integral derivative control (PIDC) function or other means performing the same or similar functions. The control 12 interfaces with an engine valve actuator 14 operable to move an engine valve 16 between an open position and a closed position.

The actuator 14 may act directly on the engine valve 16 or may act indirectly on the engine valve using hydraulic channels, or mechanical means. The position of the engine valve is monitored by an engine valve position sensor 18 which relays engine valve position information to the control 12. The control energizes and de-energizes the actuator 14 to operate the engine valve 16 according to the valve motion illustrated in FIG. 2. Particularly, the RC portion of the control produces a time invariant engine valve ramping up (opening) and ramping down (closing) valve motion profile and the PIDC portion of the control produces variable dwell durations at the valve seat and at maximum lift that vary with engine speed.

Figure 2:
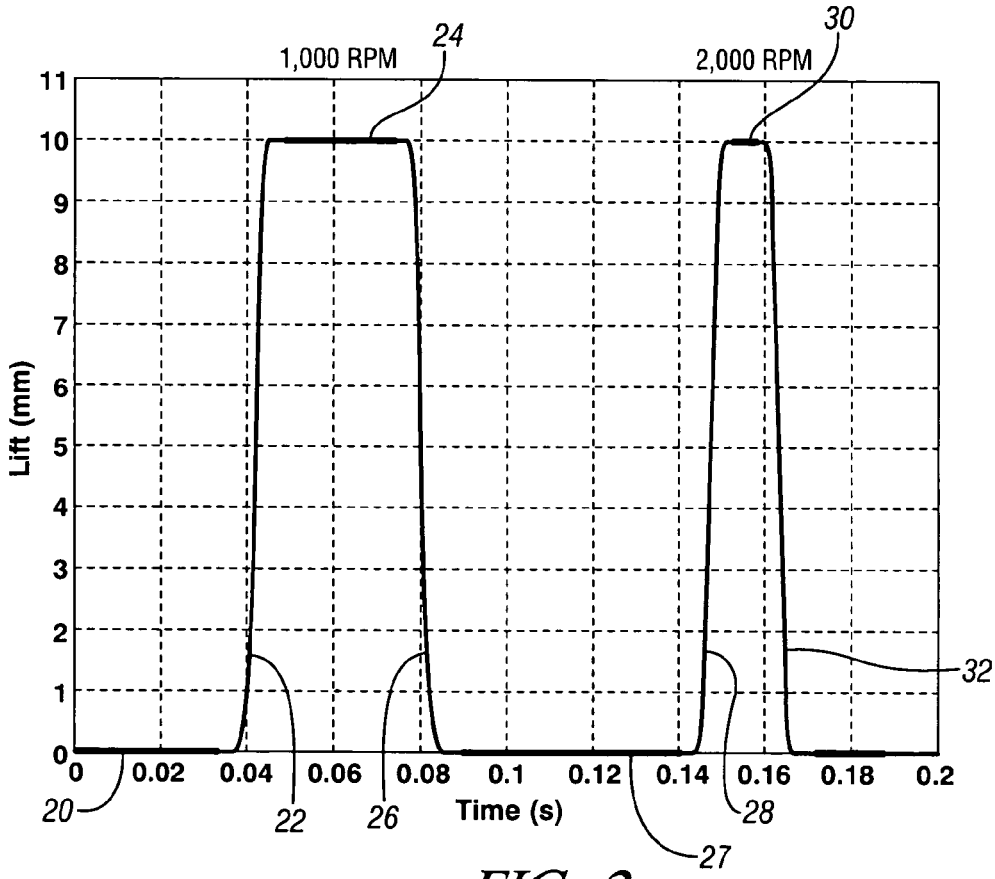
FIG. 2 is a profile of valve motion as provided by the valve actuator control of FIG. 1 at varying engine speeds.

FIG. 2 is a graph illustrating engine valve lift profiling performed according to a control algorithm of the present invention over a time period including exemplary first and second engine speeds. The engine valve lift profiles shown may be employed on various types of valve trains including, for example, electromagnetic, electromechanical, and electrohydraulic.

Lines 20, 22, 24, 26 represent a first engine valve event or cycle at an engine speed of 1,000 RPM. Line 20 (shown in part) represents seat dwell of the engine valve in a closed state or seated position. The engine valve remains in the closed state until the optimal time for engine valve opening occurs. At such time, the RC function of the control 12 causes the engine valve to open following the time invariant, or fixed opening profile represented by line 22.

Lift dwell line 24 represents the lift dwell duration of the engine valve in which the PIDC function of the control 12 maintains a constant valve lift at a desired period of time for a given engine RPM. Line 26 represents a time invariant closing profile of the engine valve 16 replicated by the RC function of the control 12. As the engine valve approaches zero mm of lift, the PIDC function of the control 12 may initiate a soft landing procedure to reduce seating velocity of the engine valve.

Since the RC function of the control 12 creates a time invariant opening curve 22 and a time invariant closing curve 26, the duration of the engine valve event is determined by the duration of seat dwell and lift dwell, which are shown by line 20, 24 and are determined by the PIDC function of the control 12. Accordingly, shortening the durations of seat dwell and lift dwell reduces the duration of the engine valve event, while increasing the durations of the seat dwell and lift dwell increases the duration of the engine valve event.

Lines 27, 28, 30, 32 represent a second engine valve event or cycle at an engine speed of 2,000 RPM. Line 27 represents the seat dwell, or duration in the valve closed position. Line 28 represents the time invariant opening profile of the engine valve, which is the same as 22. Line 30 represents the lift dwell duration of the engine valve. Line 32 represents a time invariant closing profile of the engine valve, which is the same as line 26. As shown, the seat dwell and lift dwell durations as represented by lines 27, 30 are shortened by the PIDC function of the control 12, relative to lines 20, 24. As a result, the duration of the engine valve event is reduced to maintain optimal valve timing at the higher engine speed.

Figure 3:
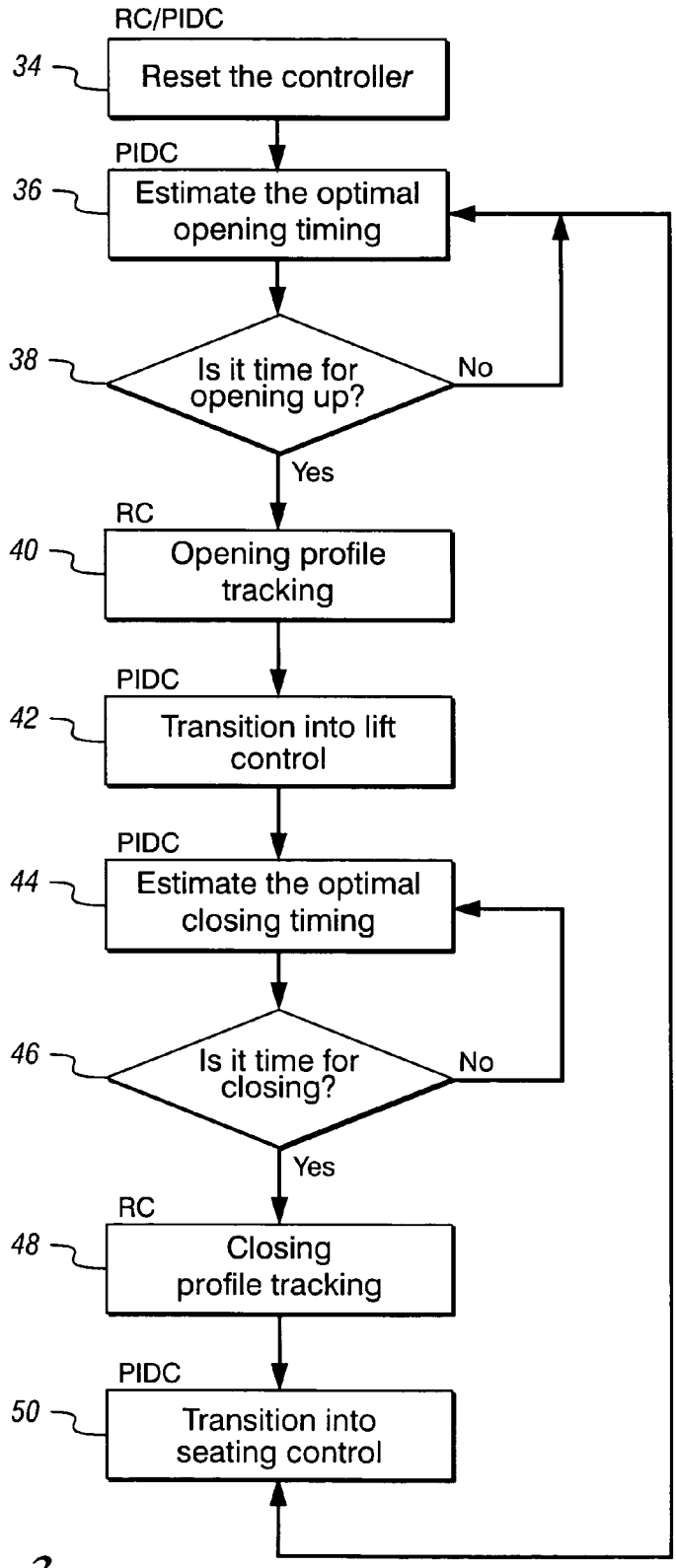
FIG. 3 is a flow chart of a control algorithm utilized by the control of FIG. 1.

The operation of the present invention is further illustrated in the flow chart of FIG. 3. The control 12 (including a RC and a PIDC) is initially reset to default settings as shown in box 34. The control 12 then monitors engine speed and crank angle to determine optimal opening timing of the engine valve 16 as shown in box 36. At the optimal time for engine valve opening, the control 12 initiates engine valve opening as shown in box 38.

As the engine valve 16 opens, the control 12 tracks the time invariant trajectory of the engine valve 16, as shown in box 40. Based upon the opening velocity and the trajectory of the engine valve 16, the control 12 transitions into lift control at the end of the opening trajectory, as shown in box 42. Based upon engine speed, the control 12 estimates the optimal engine valve lift dwell duration and closing timing as shown in box 44.

At the optimal engine valve closing timing, the control 12 initiates engine valve closing as shown in box 46. The control 12 tracks the time invariant closing profile of engine valve 16, as shown in box 48. At the end of the closing profile, the control 12 transitions into seating control, as shown in box 50. It then returns to box 36 and the procedure repeats itself. During the above process, the initial values of the RC and the PIDC functions may be set appropriately to ensure smooth transitions.

The foregoing material has described the basic features and operational algorithm of a control and method for actuation of engine valves for various forms of valve trains for engines. The invention may be applied to all forms of electronically controlled valve actuators. Following are descriptions of one specific example of valve actuator and control in which the control concepts and operating methods of the invention are applied.

Figure 4:
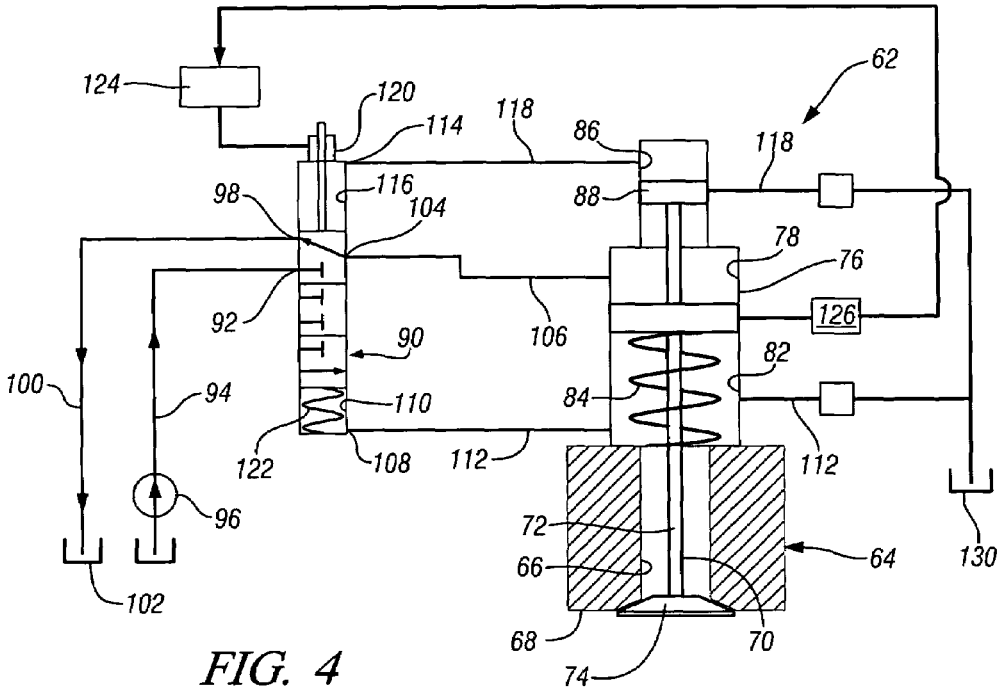
FIG. 4 is a diagrammatic view of an exemplary valve actuator assembly, illustrated in operational relationship with an engine of a vehicle.
Figure 5:
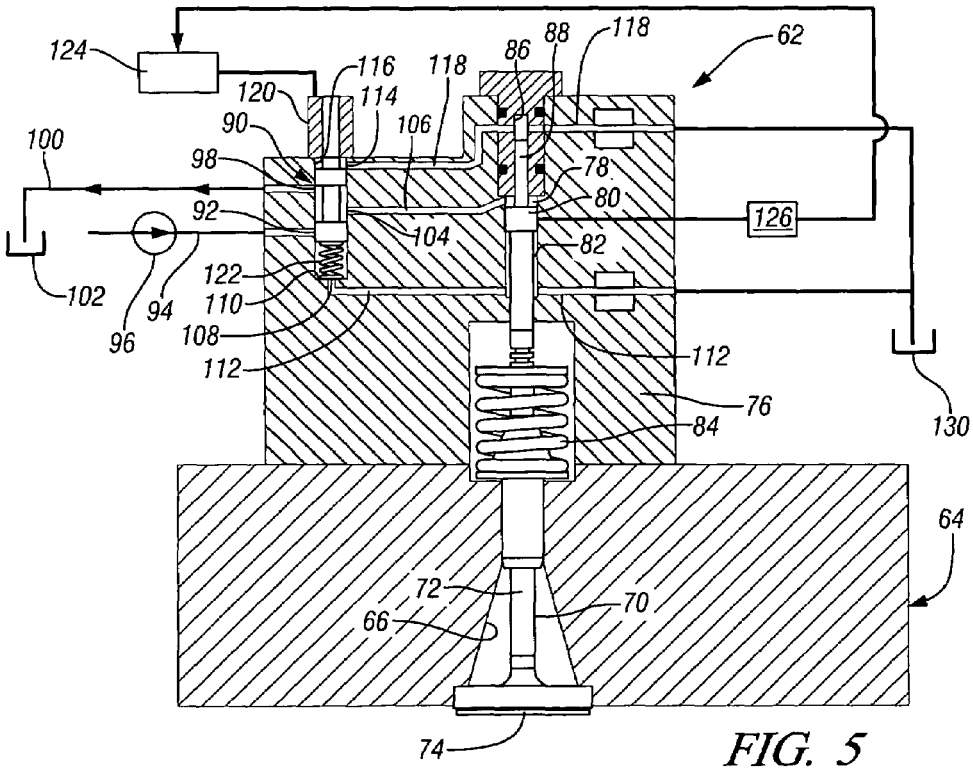
FIG. 5 is a cross-sectional view of the valve actuator assembly of FIG. 4 in an engine valve closed position.

Referring now to FIGS. 4 and 5 an exemplary embodiment is shown of an electrohydraulic valve actuator assembly 62 mounted on a cylinder head 64 including at least one opening 66 in communication with a combustion chamber 68 of an engine. The cylinder head 64 also includes a movable engine valve 70 for each opening 66. The engine valve 70 has a valve stem 72 and a valve head 74 at one end of the valve stem. The engine valve 70 is movable between open and closed positions controlling its respective opening 66. It should be understood that the engine valve 70 may be either an intake or an exhaust valve.

The valve actuator assembly 62 further includes a valve actuator housing 76 disposed adjacent the cylinder head 64. The valve housing 76 has a main or first fluid chamber 78 therein. A first piston 80 is connected to or in contact with the valve stem 72 of the engine valve 70. The piston 80 is disposed in the first fluid chamber 78 of the valve housing 76 and may form a second fluid chamber 82 therein. An engine valve spring 84 is disposed about the valve stem 72 and contacts the cylinder head 64 to bias the engine valve 70 toward the closed position so that the valve head 74 closes the opening 66, as shown in FIGS. 4 and 5.

The valve actuator assembly 62 may further include a third fluid chamber 86 axially spaced from the first fluid chamber 78 and defined by the housing 76. A second piston 88, connected to the first piston 80, may be disposed in the third fluid chamber 86.

The valve actuator assembly 62 also includes a spool valve 90 fluidly connected to the first fluid chamber 78 of the valve housing 76. The spool valve 90 is of a three position three-way type. The spool valve 90 has a high pressure port 92 fluidly connected by an intermediate channel 94 to a fluid pump 96 and a low pressure port 98 fluidly connected by a second intermediate channel 100 to a fluid tank 102. If desired, the fluid pump 96 may be fluidly connected to the fluid tank 102 or a separate fluid tank.

The spool valve 90 further includes a third port 104 fluidly connected by a driving channel 106 to the first fluid chamber 78. The spool valve 90 may also have a fourth port 108 fluidly connecting a fourth chamber 110 to the second fluid chamber 82 of the valve housing 76 via a first feedback channel 112 and a fifth port 114 fluidly connecting a fifth chamber 116 via a second feedback channel 118 to the third fluid chamber 86. The spool valve 90 is operable to control fluid flow to and from the first fluid chamber 78.

The spool valve 90 also includes an actuator 120 at one end of the spool valve 90 adjacent the optional fifth chamber 116. The spool valve 90 further includes a spool valve spring 122 disposed in the fourth chamber 110 to bias the spool valve toward the actuator 120. The spool valve spring 122 is operative to bias the spool valve 90 toward the actuator 120.

The actuator 120 is of a linear type, such as a solenoid, electrically connected to a source of electrical power, such as a control 124. The control 124 incorporates an algorithm according to the present invention, which may be implemented by a repetitive control (RC) and a proportional integral derivative control (PIDC) or other means performing the same functions.

The RC function of the control 124 energizes and de-energizes the actuator 120 to actuate the spool valve 90 and initiate opening and closing of the engine valve 70 with time invariant trajectories from cycle to cycle.

The PIDC function of the control 124 energizes and de-energizes the actuator 120 to actuate the spool valve 90 and adjust the position of the spool valve 90 when the engine valve 70 is at seat or at maximum lift and thereby alter engine valve opening and closing timing and the duration of the engine valve event.

An engine sensor 126 interfaces with the control 124 and monitors engine speed, engine valve opening velocity, lift height and dwell duration, closing timing, closing velocity and seating velocity.

In operation, as illustrated by FIG. 5, the engine valve 70 is shown in the closed position. In this position, the PIDC function of the control 124 de-energizes the actuator 120. This allows the spool valve spring 122 to move the spool valve 90 toward the actuator, closing the high pressure port 92 and opening the low pressure port 98. This communicates the first chamber 78 with the fluid tank 102 via the low pressure port 98 and allows the engine valve spring 84 to keep the engine valve 70 closed with the valve head 74 closing the opening 66.

When the engine valve 70 is still at seat, the PIDC function of the control 124 monitors the engine speed and estimates the optimal opening timing of the valve event based on the current and estimated future engine speeds. When it reaches the optimal timing, the PIDC function of the control 124 switches to RC function of the control 124 to initiate the time invariant opening trajectory.

Figure 6:
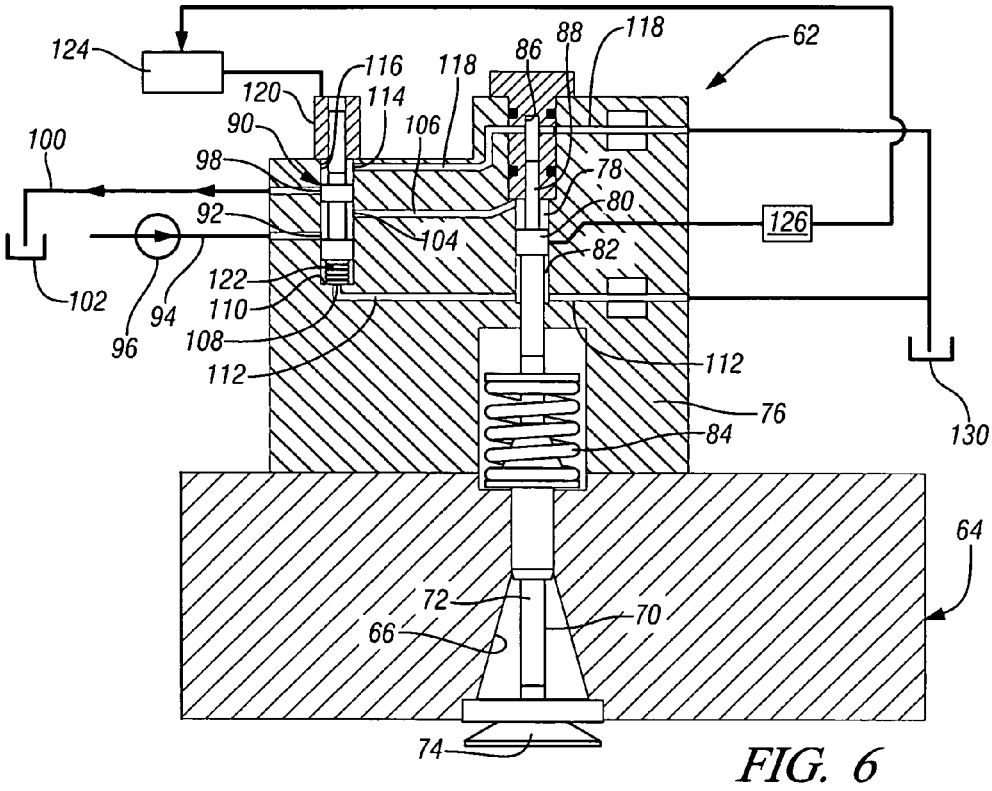
FIG. 6 is a view similar to FIG. 5 in a valve opening position.

To open the engine valve 70, as illustrated in FIG. 6, the RC function of the control 124 energizes the actuator 120 to drive the spool valve 90 against the spool valve spring 122 closing the low pressure port 98 and opening the high pressure port 92. This allows high pressure fluid to flow from the pump 96 through the spool valve 90 into the first chamber 78. The fluid pressure acts against the first piston 80 to overcome the force of the engine valve spring 84 and open the engine valve 70. During this time the sensor 126 monitors engine valve opening timing, velocity and trajectory and relays this information to control 124. Using the current sensor information and valve positioning information from last cycle, the RC function of the control 124 controls the actuator 120 to drive the engine valve 70 to track the time invariant opening trajectory.

Figure 7:
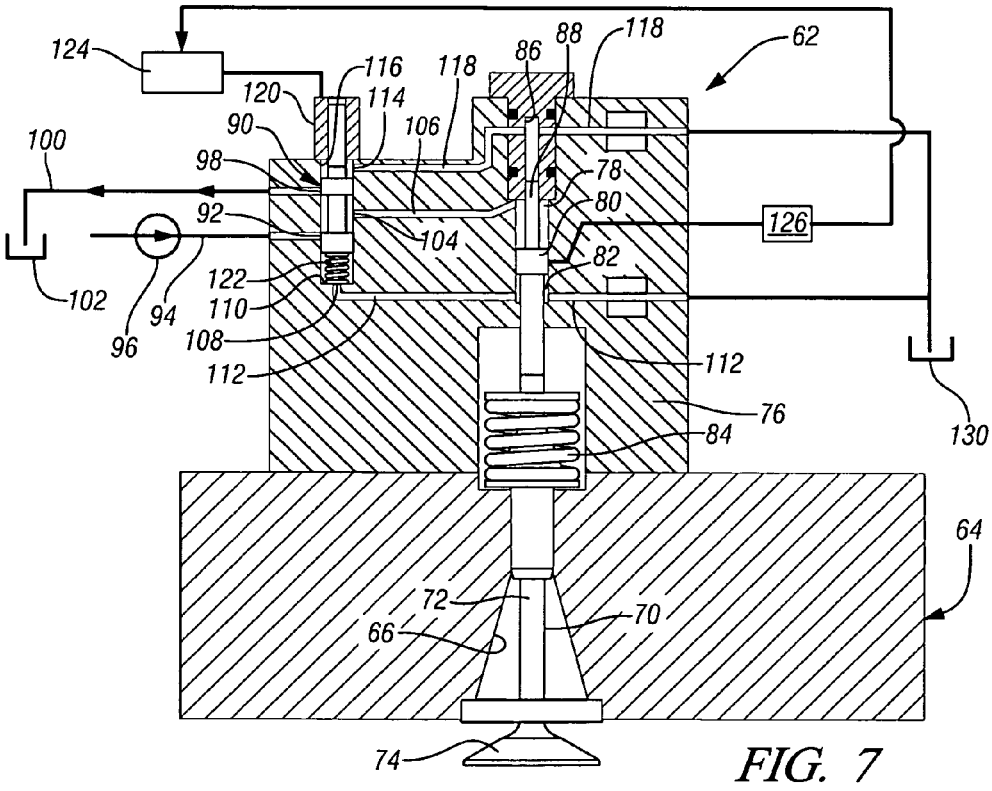
FIG. 7 is a view similar to FIG. 5 in a valve opened position.

At the end of the opening trajectory, the engine valve 70 is then held at a predetermined lift position or lift dwell, as shown in FIG. 7. The RC function of the control 124 then switches to PIDC function of the control 124 to regulate the actuator 120 and keep the engine valve 70 at the predetermined lift position. This is accomplished when the PIDC function of the control 124 energizes the actuator 120 to move the spool valve 90 to a neutral position that closes communication between the high and low pressure ports 92, 98 and thereby seals the first fluid chamber 78. As a result, the position of the first piston 80 is maintained within the first fluid chamber 78 to maintain the lift position of the engine valve 70. The duration of the lift dwell determines the duration of the engine valve event.

While the engine valve 70 is still at the predetermined lift, the PIDC function of the control 124 monitors the engine speed from the sensor 126 and estimates the optimal closing timing for the valve event based on the current and estimated future engine speeds. After a desired lift dwell duration, the engine valve 70 closes. The PIDC function of the control 124 switches to RC function of the control 124 to initiate the time invariant closing trajectory.

Figure 8:
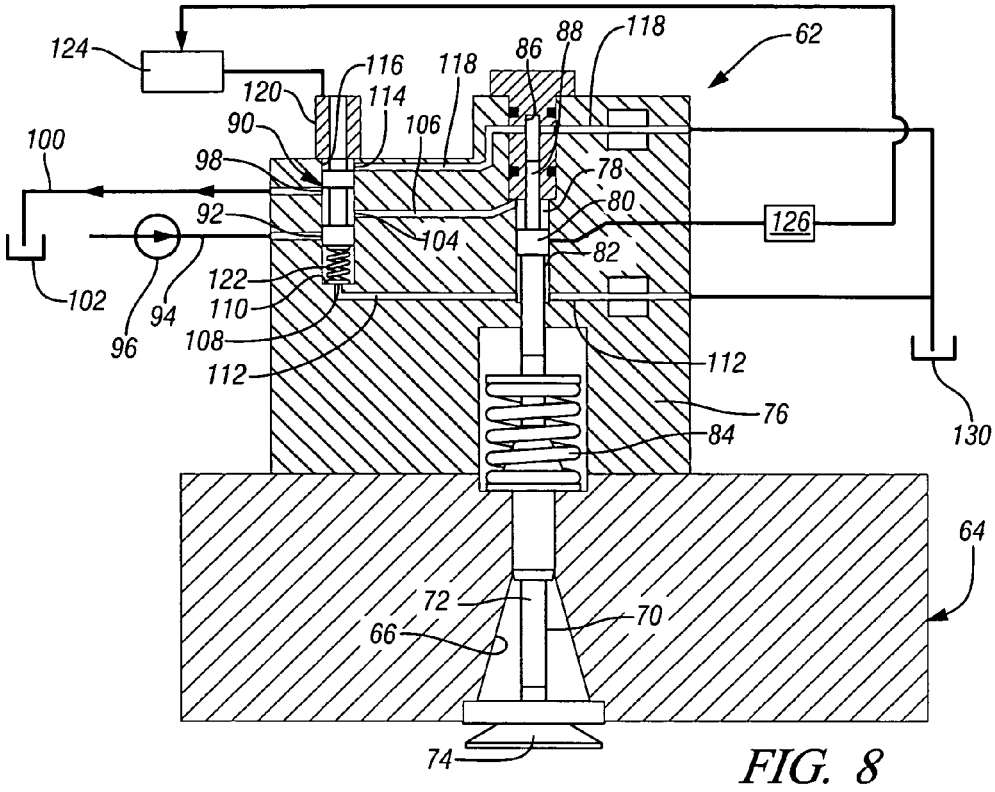
FIG. 8 is a view similar to FIG. 5 in a valve closing position.

As shown in FIG. 8, using the current sensor information 126 and the valve positioning information from last cycle, the RC function of the control 124 controls the actuator 120 to drive the engine valve 70 to track the time invariant closing trajectory. This is accomplished when the RC function of the control 124 de-energizes the spool valve 90. The spool valve spring 122 returns the spool valve 90 to a position which communicates the first chamber 78 with the second intermediate channel 100 and the fluid tank 102. This allows the high pressure fluid in the first chamber 78 to exhaust into the fluid tank 102. The engine valve spring 84 then drives the engine valve 70 upward, as illustrated in FIG. 8. The second fluid chamber and the third fluid chamber 82 and 86 are connected with the tank 130 so that, as the engine valve 70 returns to the closed position, low pressure fluid refills the second fluid chamber from the third fluid chamber and from the tank 130.

Figure 9:
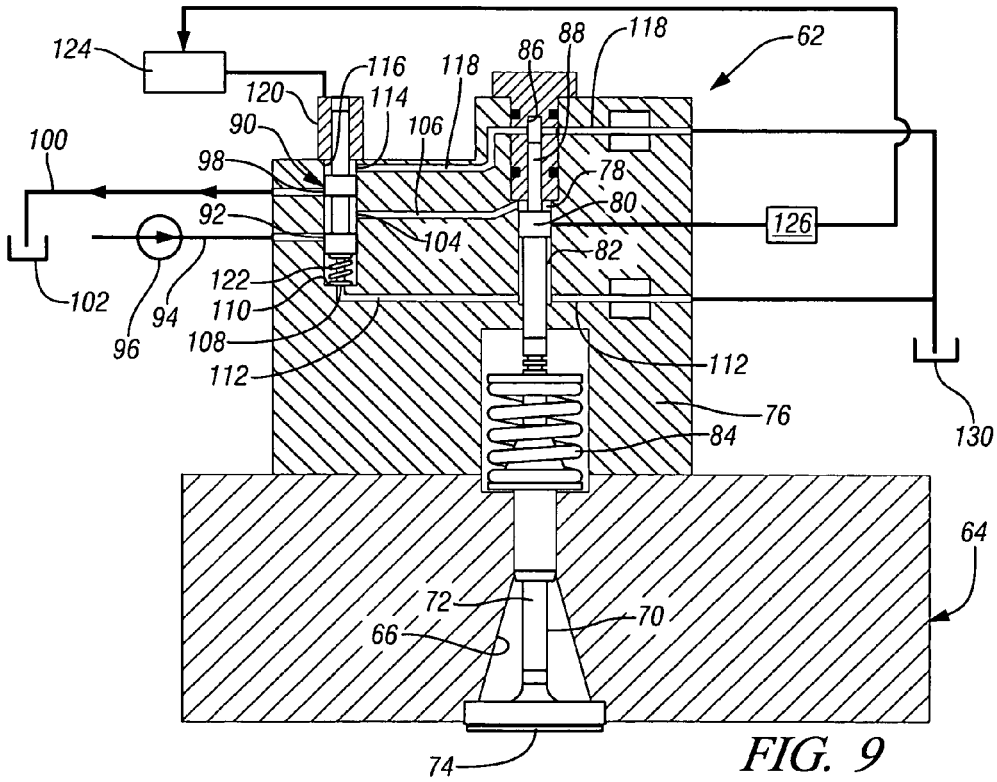
FIG. 9 is a view similar to FIG. 5 in a valve closed position.

At the end of the closing trajectory, the engine valve 70 is at seat. The RC function of the control 124 then switches to PIDC function of the control 124 to keep the engine valve 70 at seat. This is shown in FIG. 9.

It should be understood that various other valve control embodiments could also be operated to provide the method of valve motion control broadly described herein.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A method for controlling operation of an engine valve during both steady state and varying speed operation of an engine, the method comprising the steps of:

1a) prior to step 1, performing the steps of:

during a valve closed dwell period, estimating the timing for the next valve opening step; and confirming reaching of the valve opening time;

1) at the predetermined valve opening time relating to engine speed, performing valve opening along a predetermined time invariant opening profile;

2) holding the valve open at a selected valve lift for a variable time period relating to engine speed;

3a) prior to step 3, performing the steps of:

estimating the timing for the next valve closing step; and confirming reaching of the valve closing time;

3) at the predetermined valve closing time relating to engine speed, performing valve closing along a predetermined time invariant closing profile;

4) holding the valve closed for a variable estimated time period relating to engine speed; and repeating steps 1*a* through 4 during continued operation of the engine.

2. A method as in claim 1 including:

using a repetitive control (RC) for performing steps 1 and 3.

3. A method as in claim 2 including:

using a proportional integral derivative control (PIDC) for performing steps 2 and 4.

4. A method as in claim 1 including tracking the valve profiles of the opening and closing steps 1 and 3, and correcting the method for errors in the profiles in the previous opening and closing steps.

5. An engine valve actuator assembly, comprising:

an engine valve movable between an open position and a closed position;

an engine valve actuator operable to move the engine valve between the open position and the closed position;

a control having a repetitive control function operable to energize and de-energize the actuator to move the engine valve at a time invariant ramping profile between the open position and the closed position; and the control also having a proportional integral derivative control function operable to energize and de-energize the actuator to maintain a desired engine valve lift dwell duration;

an engine valve position sensor interfacing with the control and the repetitive control function and the proportional integral derivative control function and the control being operative to track engine valve ramping velocity and trajectory, engine valve timing and engine valve lift dwell duration;

the proportional integral derivative control function having a control algorithm to calculate optimal engine valve lift dwell duration at a given engine RPM to obtain optimal engine valve cycle timing for a given RPM; and the proportional integral derivative control function adjusting energizing the actuator to maintain optimal engine valve lift duration for the given RPM.

6. An engine valve actuator assembly as in claim 5 wherein the actuator drives a movable spool valve operable to selectively provide fluid flow to and from a driving channel to position the engine valve between an open position and the closed position.

7. An engine valve actuator assembly as in claim 6 including a first feedback channel interconnecting the engine valve, the spool valve and a first on/off valve, and a second feedback channel interconnecting the engine valve, the spool valve and a second on/off valve.

8. A valve actuator assembly as in claim 7 including a valve housing having a first fluid chamber fluidly communicating with the driving channel and a second fluid chamber fluidly communicating with the first feedback channel.

9. A valve actuator assembly as in claim 8 including a first piston operatively cooperating with the engine valve and movably disposed in the valve housing operatively between the first fluid chamber and the second fluid chamber.

10. A valve actuator assembly as in claim 8 wherein the first feedback channel interconnects the second fluid chamber and a fourth fluid chamber of the spool valve.

11. A valve actuator assembly as in claim 8 wherein the valve housing has a third fluid chamber fluidly communicating with the second feedback channel.

12. A valve actuator assembly as in claim 11 including a second piston operatively cooperating with the engine valve and disposed in the valve housing, one side of the second piston being open to the third fluid chamber.

13. A valve actuator assembly as in claim 12 wherein the second feedback channel interconnects the third fluid chamber with a fifth fluid chamber of the spool valve.

14. A valve actuator assembly as in claim 13 including a fourth fluid chamber at one end of the spool valve and fluidly communicating with the first feedback channel and a fifth fluid chamber at an opposite end of the spool valve and fluidly communicating with the second feedback channel.

* * * * *